United States Patent [19]

Strand

[11] Patent Number: 5,037,086

[45] Date of Patent: Aug. 6, 1991

[54] BALANCE BEAM WITH REFLEX MECHANISM

[75] Inventor: Vincent T. Strand, Ames, Iowa

[73] Assignee: American Sports International, Ltd., Jefferson, Iowa

[21] Appl. No.: 516,808

[22] Filed: Apr. 30, 1990

[51] Int. Cl.[5] ..... A63B 4/00; A63B 5/08; A47B 9/12; F16M 13/00

[52] U.S. Cl. ..... 272/111; 272/109; 108/117; 108/144; 248/560

[58] Field of Search ..... 272/103, 109, 64, 144, 272/111; 269/310; 248/560, 573, 580, 581, 624, 160; 5/11, 63, 65; 108/116, 117, 127, 144, 145

[56] References Cited

U.S. PATENT DOCUMENTS

| | | | |
|---|---|---|---|
| 552,142 | 6/1894 | Barrett | 248/560 |
| 2,636,246 | 4/1953 | Quaka | 5/11 |
| 2,833,063 | 5/1958 | Drummond | 108/117 |
| 4,143,602 | 3/1979 | Brenn | 108/117 |
| 4,445,671 | 5/1984 | Reuschenbach et al. | 108/144 |
| 4,615,279 | 10/1986 | de la Haye | 108/144 |

FOREIGN PATENT DOCUMENTS

| | | | |
|---|---|---|---|
| 1097349 | 6/1984 | U.S.S.R. | 272/66 |
| 638538 | 6/1950 | United Kingdom | 108/127 |

*Primary Examiner*—Richard J. Apley
*Assistant Examiner*—Karen G. Horowitz
*Attorney, Agent, or Firm*—Zarley, McKee, Thomte, Voorhees, & Sease

[57] ABSTRACT

A balance beam is disclosed which utilizes a conventional beam member with conventional support legs wherein the upper ends of the support legs are mounted in a bracket secured to the lower surface of the beam. The bracket has spaced elongated angularly disposed slots in which a transverse pin is mounted. The pin is also secured to the upper ends of the leg members. A spring mechanism is secured to the bracket and engages the upper end of the leg member to hold the pin and the upper end of the leg member in a position at the upper end of the slots. When the gymnast lands on the beam, the weight of the gymnast causes the spring mechanism to compress which permits the pin in the upper ends of the leg members to move downwardly in the slots to partially absorb the impact of the gymnast's weight. The immediate recovery of the spring imparts some impetus to the gymnast as the gymnastic routine is continued immediately after the moment of impact. At the moment of impact, the beam moves from a first horizontal position to a slightly lower horizontal position as the pin moves downwardly in the slots as the compression spring is compressed.

12 Claims, 1 Drawing Sheet

BALANCE BEAM WITH REFLEX MECHANISM

BACKGROUND OF THE INVENTION

Gymnastic balance beams are comprised of elongated rigid body members elevated from a floor surface by rigidly attached legs mounted directly under the body member and normally positioned at opposite ends thereof.

When a gymnast performs on the balance beam, the full weight of the gymnast is impacted on the beam a number of times in a typical routine. The rigid beam absorbs little if any of the impact of the gymnast, and provides no spring to the gymnast as the routine is continued following the moment of impact.

It is therefore the principal object of this invention to provide a balance beam with a reflex mechanism which will both absorb some of the impact of the gymnast's weight, and which will provide some impetus to the gymnast immediately following the moment of impact.

A further object of this invention is to provide a balance beam with a reflex mechanism which is safe, durable, and easily serviced or repaired.

These and other objects will be apparent to those skilled in the art.

BRIEF SUMMARY OF THE INVENTION

A balance beam is disclosed which utilizes a conventional beam member with conventional support legs wherein the upper ends of the support legs are mounted in a bracket secured to the lower surface of the beam. The bracket has spaced elongated angularly disposed slots in which a transverse pin is mounted. The pin is also secured to the upper ends of the leg members.

A spring mechanism is secured to the bracket and engages the upper end of the leg member to hold the pin and the upper end of the leg member in a position at the upper end of the slots.

When the gymnast lands on the beam, the weight of the gymnast causes the spring mechanism to compress which permits the pin in the upper ends of the leg members to move downwardly in the slots to partially absorb the impact of the gymnast's weight. The immediate recovery of the spring imparts some impetus to the gymnast as the gymnastic routine is continued immediately after the moment of impact. At the moment of impact, the beam moves from a first horizontal position to a slightly lower horizontal position as the pin moves downwardly in the slots as the compression spring is compressed.

Figures 1, 2, 3, 4:
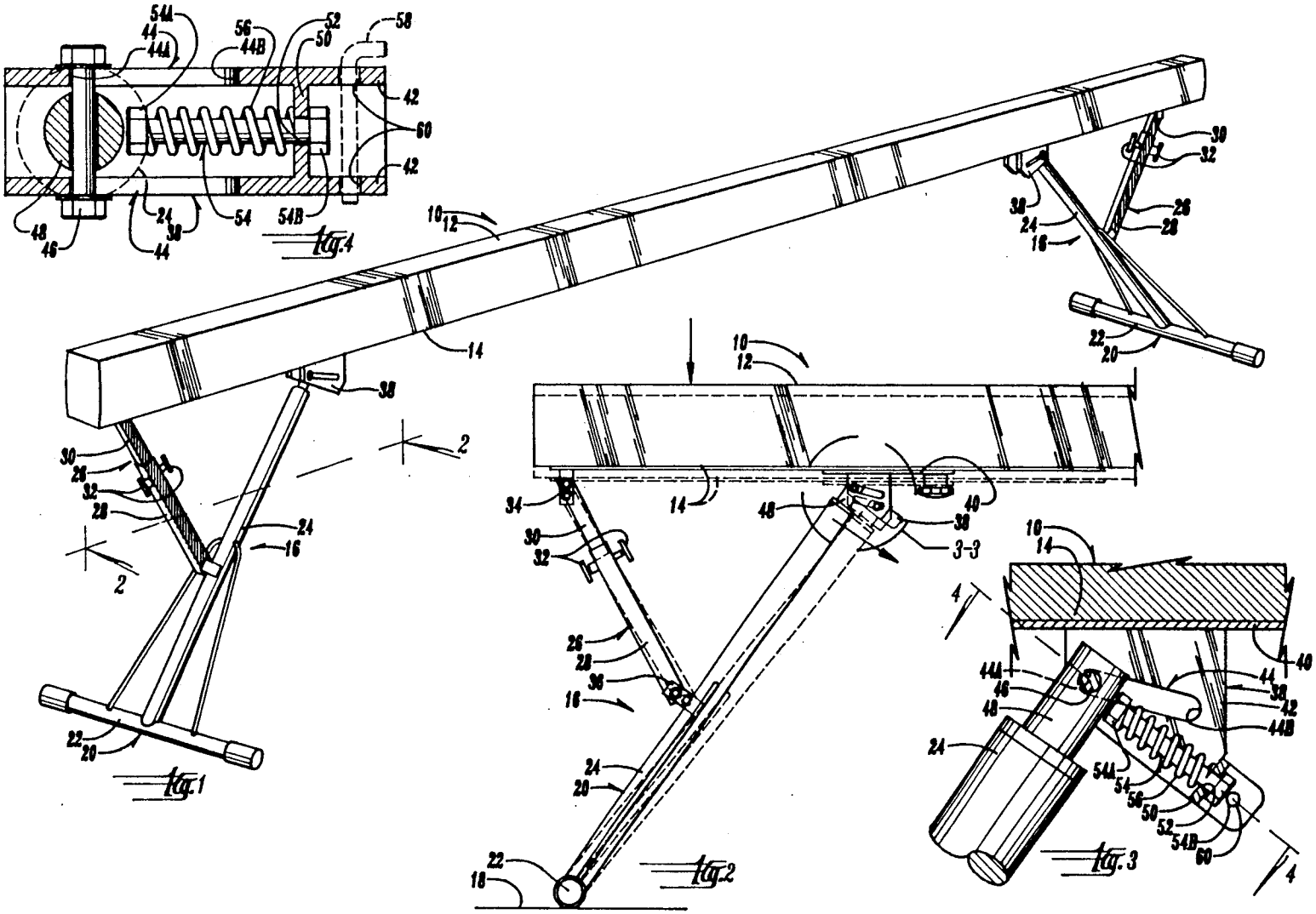
FIG. 1 is a perspective view of the balance beam of this invention.
FIG. 2 is a partial elevational view of the balance beam of FIG. 1 taken on line 2—2 of FIG. 1 and shown at a slightly larger scale.
FIG. 3 is a partial sectional view at an enlarged scale taken on line 3—3 of FIG. 2.

4 is an enlarged scale sectional view taken on line 4—4 of FIG. 3.

DESCRIPTION OF THE PREFERRED EMBODIMENT

The conventional balance beam 10 has a top surface 12 and a bottom surface 14. Legs 16 extend upwardly from a supporting floor surface 18 and are operatively connected to the bottom surface 14 of beam 10 as described hereafter.

Legs 16 are comprised of T-shaped leg members 20 which in turn are comprised of transverse floor engaging horizontal members 22. An upright leg strut 24 is rigidly secured to the center of members 22. A telescopic brace 26 is comprised of a lower member 28 and an upper member 30 which can have their telescopic movement limited by use of conventional stop bolts 32. Brace 26 is pivotally connected to the bottom surface 14 of beam 10 by means of pivotal connection 34. The lower end of brace 26 is pivotally secured to leg member 20 by pivotal connection 36.

Two brackets 38 are secured to the bottom surface 14 of beam 10 in any convenient manner. Typically, brackets 38 have an upper portion 40 which is a part of a slide track movably secured to the beam and adapted for selective longitudinal positioning so that the effective height of the beam can be adjusted. The details of this slide track, not forming a part of this invention, have not been shown. When the, height of the beam is set, the brackets 38 are rigid with the beam and are not capable of longitudinal movement.

Brackets 38 have opposite sides 42 in which parallel and angularly disposed slots 44 appear. Slots 44 have upper ends **44*a* and lower ends 44*b*. Each bracket has a pin 46 that extends transversely through the slots in the sides 42. The pins 46 are secured to the upper ends 48 of leg strut 24**.

A transverse flange 50 (FIG. 4) extends between sides 42, and hole 52 appears in flange 50. A spring pin 54 is slidably mounted in hole 52 and has upper enlarged end **54*a* and lower enlarged end 54*b*. A compression spring 56 surrounds pin 54 with one end bearing against enlarged upper end 54*a* and the other end bearing against flange 50**.

A transverse locking pin 58 can be extended through aligning apertures 60 in the bracket sides 42 to selectively lock the pin 54 in rigid inoperative position if such is desired.

In operation, the beam 10 and upper ends 48 of leg struts 24 are in the position shown by the solid lines in all figures while the beam is not in use.

When the weight of the gymnast is impacted on beam 10 during various aspects of the gymnastic routine, the upper ends 48 of the leg members are forced downwardly against the upper ends **54*a* of spring pins 54 which causes the springs 56 to compress. This allows the pins 46 which are secured to the upper ends 48 of the leg strut to move downwardly in the slots 44. This causes the effective height of the beam 10 to move from the position of the solid lines in FIG. 2 to the slightly lower position shown by the dotted lines. This differential in height is the vertical differential in height between the upper ends 44*a* of slots 44 and the lower ends 44*b*** thereof.

As soon as the impact of the gymnast is absorbed by springs 56, the springs expand and return the beam 10 to the position of the solid lines shown in FIG. 2. This movement is rapid and virtually imperceptible. Nevertheless, it adds to the safety, comfort and utility of the device.

The locking pin 58 can be inserted through aperture 60 in the bracket as shown in FIG. 4 to lock or otherwise limit the compression of spring 56 by preventing the pin 56 from sliding through aperture 52 in response to pressure on the upper end **54*a* thereof applied by the upper end 48 of the leg strut 24**.

The feature of resiliency and reflex has therefore been added to the conventional balance beam. It is therefore seen that this invention will achieve at least its stated objectives.

I claim:

1. A gymnastic device comprising:

an elongated substantially rigid body member upon which a gymnast will perform, having upper and lower surfaces, a support means to hold the body member in an elevated substantially horizontal position, comprising spaced apart elongated rigid leg members extending from a floor support surface upwardly towards the lower surface of said body member, a separate bracket member connecting an upper end of each leg member to the lower surface of said body member, connection means on each of said bracket members to permit said leg members to engage said brackets at a first upper position on said brackets to support said body member in a first horizontal position, and to permit said leg member to move with respect to said brackets to a second and slightly lower horizontal position on said brackets to support said body member in a second and slightly lower horizontal position, and resilient means on said brackets yieldingly holding said body member in said first horizontal position but permitting said body member to move towards said second and slightly lower horizontal position when said body member is impacted by the weight of a gymnast performing thereon.

2. The device of claim 1 wherein said body member is a balance beam.

3. The device of claim 1 wherein said leg members pivot about their point of engagement with said floor surface as said body member moves from said first horizontal position to said second and lower horizontal position.

4. The device of claim 1 wherein said bracket members are U-shaped and have a top portion engaging the lower surface of said body member, and opposite parallel spaced side members extending parallel to the longitudinal axis of said body member, angularly disposed parallel elongated slots having upper and lower ends in said side members, the upper ends of said leg members extending into the space between said side members, a transverse pin slidably mounted in and having opposite ends slidably mounted in said slots, said pins being connected to the upper ends of said leg members extending into the space between said side members, said pins normally dwelling in the upper ends of said slots when said body member is in said first position.

5. The device of claim 4 wherein said body member is a balance beam.

6. The device of claim 4 wherein said leg members pivot about their point of engagement with said floor surface as said body member moves from said first horizontal position to said second and lower horizontal position.

7. The device of claim 1 wherein said resilient means is a compression spring.

8. The device of claim 4 wherein said resilient means is a compression spring.

9. The device of claim 4 wherein said resilient means is a compression spring mounted on said bracket and operative with the upper end of the leg members extending into the space between said side members to yieldingly hold said pins in the upper ends of said slots.

10. The device of claim 9 wherein a spring pin is slidably mounted on each of said brackets, said spring pin dwelling in substantially the same plane as the upper ends of said leg members, said spring pins having upper and lower ends with said upper ends thereof normally engaging the upper ends of said leg members, a compression spring member around each of said spring pins and normally holding said spring pins into yielding engagement with said upper ends of said leg members to hold said body member in said first horizontal position.

11. The device of claim 10 wherein lock means are on said brackets and being operative with said leg members to permit said leg members to be selectively locked against movement with respect to said brackets.

12. The device of claim 11 wherein said body member is a balance beam.

* * * * *